United States Patent [19]

Lewis

[11] 4,130,309

[45] Dec. 19, 1978

[54] VENT WINDOW LOCK ASSEMBLY

[76] Inventor: Mary E. Lewis, 639 Maria Ave., Spring Valley, Calif. 92077

[21] Appl. No.: 854,154

[22] Filed: Nov. 23, 1977

[51] Int. Cl.[2] ..... E05C 17/54

[52] U.S. Cl. ..... 292/258; 292/DIG. 6

[58] Field of Search ..... 292/DIG. 6, 258, 288, 292/114, 67, 105

[56] References Cited

U.S. PATENT DOCUMENTS

| | | | |
|---|---|---|---|
| 1,631,355 | 6/1927 | Baldwin | 292/258 X |
| 2,151,934 | 3/1939 | Parrott | 292/DIG. 6 |
| 2,168,677 | 8/1939 | McKeen | 292/DIG. 6 |
| 2,196,478 | 4/1940 | Simpson | 292/DIG. 6 |
| 2,396,982 | 3/1946 | Bousquet | 292/258 X |
| 3,722,935 | 3/1973 | Latib | 292/DIG. 6 |
| 3,938,839 | 2/1976 | Collier | 292/258 |
| 4,078,835 | 3/1978 | Spencer | 292/258 X |

*Primary Examiner*—Richard E. Moore
*Attorney, Agent, or Firm*—Brown & Martin

[57] ABSTRACT

A vent window lock assembly for securing a pivotable vent window having a vertical edge at one end to a vertical window post having a wing flange against which said end of the vent window resides when the window is closed, is disclosed. The lock assembly includes an S-shaped bracket, a hook plate, and a fastener. The S-shaped bracket defines opposed first and second overlapping channels. The first channel is adapted for gripping the vertical edge of the vent window, with the end portion of the bracket that defines the first channel being for positioned on the outside of the vent window. The second channel is adapted for gripping the wing flange of the window post, with the end portion of the bracket that defines the second channel being positioned on the inside of the window post. The hook plate is slidably fastened to the end portion of the bracket that defines the second channel. One end of the hook plate extends away from the bracket and defines a hook for gripping the side of the window post opposite the wing flange. The fastener enables the hook plate to be selectively either slidably or tightly fastened to the bracket.

To install the lock assembly, the vertical edge of the vent window is moved into the first channel of the bracket while the window is open and as the vent window is being closed while pivoting the end portion of the bracket defining the second channel about the window post. The bracket is secured to the window post after the window is so closed by sliding the hook plate until the hook grips the window post, and then tightly fastening the hook plate to the bracket.

3 Claims, 5 Drawing Figures

VENT WINDOW LOCK ASSEMBLY

BACKGROUND OF THE INVENTION

The present invention generally pertains to lock assemblies and is particularly directed to a vent window lock assembly for securing a pivotable vent window having a vertical edge at one end to a vertical window post having a wing flange against which the end of the vent window resides when the window is closed.

Motor vehicles long have been susceptible to break-in even though the doors have been locked. Vehicles having vent windows have been broken into by prying open the vent window with a strong thin object such as a screw driver inserted at the top of the window, and then by inserting a stiff wire having a hook at the end through the pried-open window in order to manipulate the lock lever of the vent window and/or the lock lever of the door.

There is available a prior art lock assembly for securing the vent window to the window post in such a manner that the window cannot be pried open by inserting a screw driver at the top of the vent window. However, this prior art lock assembly includes a latch, and three separate U-channel components that must be fitted together in such a manner that installation is neither easy nor quick.

SUMMARY OF THE INVENTION

The present invention is a vent window lock assembly for securing a pivotable vent window having a vertical edge at one end to a vertical window post having a wing flange against which the end of the vent window resides when the window is closed. The lock of the present invention includes an S-shaped bracket, a hook plate and a fastener. The S-shaped bracket defines opposed first and second overlapping channels. The first channel is adapted for gripping the vertical edge of the vent window, with the end portion of the bracket that defines the first channel being for positioning on the outside of the vent window. The second channel is adapted for gripping the wing flange of the window post, with the end portion of the bracket that defines the second channel being for positioning on the inside of the window post. The hook plate is slidably fastened to the end portion of the bracket that defines the second channel. One end of the hook plate extends away from the bracket and defines a hook for gripping the side of the window post opposite the wing flange. The fastener is adapted for enabling the hook plate to be tightly fastened to the bracket.

The lock assembly of the present invention may be installed quickly and easily by the following procedure. The vertical edge of the vent window is moved into the first channel of the bracket while the window is open and as the vent window is being closed while pivoting the end portion of the bracket defining the second channel about the window post. The bracket is secured to the window post after the window is so closed by sliding the hook plate until the hook grips the window post, and then tightly fastening the hook plate to the bracket. A vent window that is secured to the window post by the lock assembly of the present invention cannot be pried open by inserting an object such as a screw driver at the edge of the window.

In a preferred embodiment of the vent window lock assembly according to the present invention, the end portion of the bracket that defines the second channel contains an elongated slot parallel to its longitudinal axis; and the lock assembly includes a bolt secured to the hook plate to be slidably movable within the slot of the bracket; and a wing nut engaged with the bolt to fasten the hook plate to the bracket, whereby the wing nut may be turned selectively for either slidably or tightly fastening the hook plate to the bracket.

In an alternative preferred embodiment the vent window lock assembly further includes a shim attached to the hook plate for enabling the hook plate to fit tightly against the window post when the bracket is secured to the window post.

DESCRIPTION OF THE PREFERRED EMBODIMENTS

Figure 1:
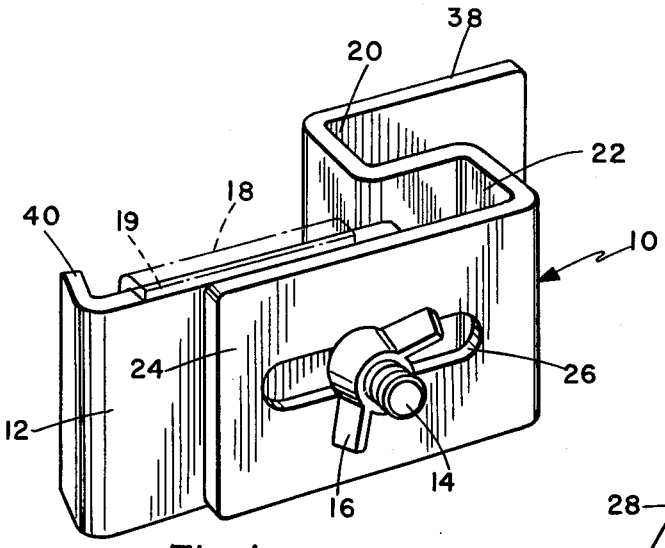
FIG. 1 is a perspective view of the vent window lock assembly.

Referring to FIG. 1, the preferred embodiment of the vent window lock assembly of the present invention includes an S-shaped bracket 10, a hook plate 12 and a fastener consisting of a bolt 14 that is secured to the hook plate 12 and a wing nut 16 for engagement with the bolt 14. Alternatively the lock assembly may also include a shim 18 which is attached to the hook plate 12 by means of a flange 19 resting on top of the hook plate 12, as shown in FIG. 1.

The S-shaped bracket 10 defines a first channel 20 and a second channel 22 that overlaps and opposes the first channel 20. The end portion 24 of the S-shaped bracket 10 that defines the second channel 22 contains an elongated slot 26 that is parallel to its longitudinal axis. The bolt 14 is positioned to be slidably movable within the slot 14 of the bracket 10.

Figure 2:
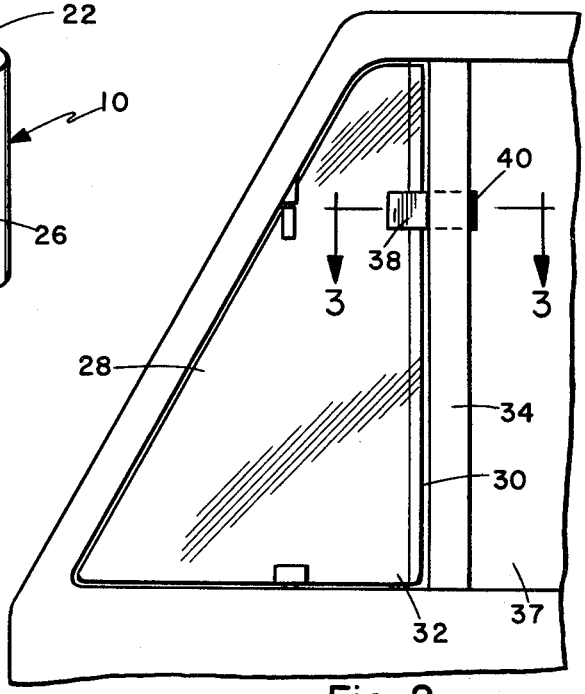
FIG. 2 illustrates the lock assembly applied to a vent window in a vehicle door.
Figure 3:
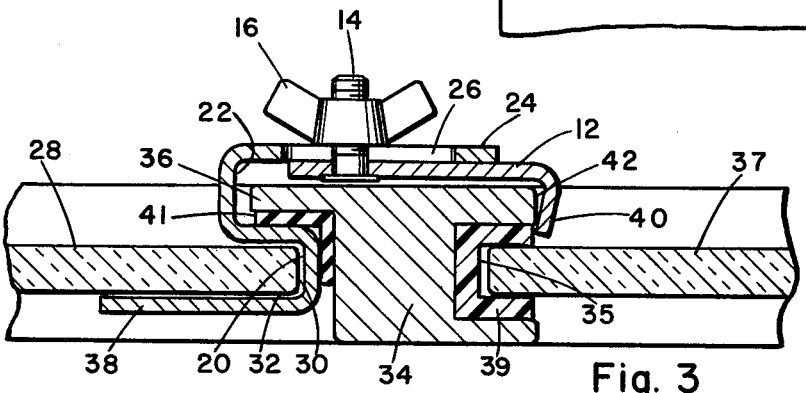
FIG. 3 is an enlarged sectional view taken on line 3—3 of FIG. 2.

In FIGS. 2 and 3 the lock assembly of the present invention is shown as installed for securing a pivotable vent window 28 having a vertical edge 30 at one end 32 to a vertical window post 34 having a wing flange 36, against which the end 32 of the vent window 28 resides when the window 28 is closed.

The window post 34 also defines a window channel 35 for receiving a slidable door window 37. The window channel 35 typically is lined by a plastic seal 39, or by a reinforced felt seal (not shown). The wing flange 36 typically has a rubber seal 41 secured thereto.

The first channel 20 of the bracket 10 is adapted for gripping the vertical edge 30 of the vent window 28. The end portion 38 of the bracket 10 that defines the first channel 20 is positioned on the outside of the vent window 28. The second channel 22 is adapted for gripping the wing flange 36. The end portion 24 of the bracket 10 that defines the second channel 22 is positioned on the inside of the window post 34.

The hook plate 12 is slidably fastened by the bolt 14 and the wing nut 16 to the end portion 24 of the bracket 10. One end 40 of the hook plate 12 extends away from the bracket 10 and defines a hook for gripping the side 42 of the window post 34 opposite the wing flange 36.

The shim 18 is attached to the hook plate 12 when the size of the window post 34 is such that the shim 18 is required to provide a tight fit between the hook plate 12 and the window post 34 when the bracket 10 is secured to the post 34.

Figure 4:
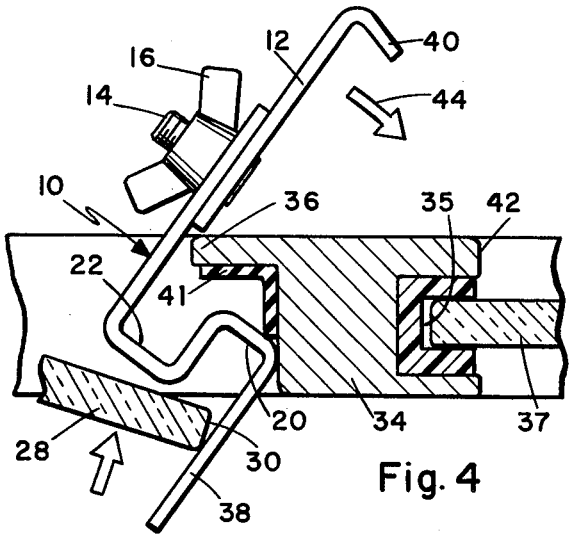
FIG. 4 is a view similar to FIG. 3, showing the initial insertion of the lock assembly.
Figure 5:
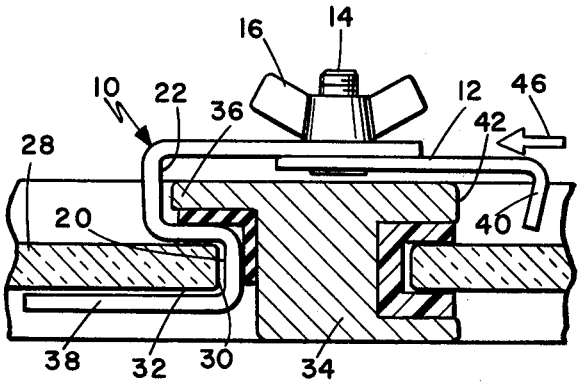
FIG. 5 is a further similar view showing the lock assembly installed but not locked.

Referring to FIGS. 3, 4 and 5, the lock assembly is easily installed in the following manner. The vertical edge 30 of the vent window 28 is moved into the first channel 20 of the bracket 10 while the window 28 is open and as the vent window 28 is being closed while pivoting the end portion 24 of the bracket 10 about the window post 34 (FIG. 4) in the direction of the arrow 44. The bracket 10 is secured to the window post 34 after the window 28 is so closed (FIG. 5) by sliding the hook plate 12 in the direction of the arrow 46 until the hook 40 grips the window post 34 (FIG. 3), and then tightly fastening the hook plate 12 to the bracket 10. The wing nut 16 is turned selectively for either slidably or tightly fastening the hook plate 12 to the bracket 10.

I claim:

1. A vent window lock assembly for securing a pivotable vent window having a vertical edge at one end to a vertical window post having a wing flange against which the end of the vent window resides when the window is closed, said assembly comprising an S-shaped bracket defining opposed first and second overlapping channels wherein the first channel is adapted for gripping the vertical edge of the vent window, with the end portion of the bracket that defines the first channel being for positioning on the outside of the vent window, and the second channel is adapted for gripping the wing flange of the window post, with the end portion of the bracket that defines the second channel being for positioning on the inside of the window post;

a hook plate slidably fastened to the end portion of the bracket that defines the second channel, wherein one end of the hook plate extends away from the bracket and defines a hook for gripping the side of the window post opposite the wing flange; and means for tightly fastening the hook plate to the bracket;

whereby the vertical edge of the vent window may be moved into the first channel of the bracket while the window is open and as the vent window is being closed while pivoting the end portion of the bracket defining the second channel about the window post; and the bracket can be secured to the window post after the window is so closed by sliding the hook plate until the hook grips the window post, and then tightly fastening the hook plate to the bracket.

2. A vent window lock assembly according claim 1, wherein the end portion of the bracket that defines the second channel contains an elongated slot parallel to its longitudinal axis; and the means for fastening the hook plate to the bracket comprises a bolt secured to the hook plate to be slidably movable within the slot of the bracket; and a wing nut engaged with the bolt to fasten the hook plate to the bracket, whereby the wing nut may be turned selectively for either slidably or tightly fastening the hook plate to the bracket.

3. A vent window lock assembly according to claim 1, further comprising a shim attached to the hook plate for enabling the hook plate to fit tightly against the window post when the bracket is secured to the window post.

* * * * *